US011161005B1

(12) United States Patent
Farrow

(10) Patent No.: US 11,161,005 B1
(45) Date of Patent: Nov. 2, 2021

(54) WEIGHTLIFTING EXERCISE DEVICE

(71) Applicant: Devin Farrow, Fayetteville, NC (US)

(72) Inventor: Devin Farrow, Fayetteville, NC (US)

( * ) Notice: Subject to any disclaimer, the term of this patent is extended or adjusted under 35 U.S.C. 154(b) by 3 days.

(21) Appl. No.: 16/910,780

(22) Filed: Jun. 24, 2020

Related U.S. Application Data

(60) Provisional application No. 63/014,769, filed on Apr. 24, 2020.

(51) Int. Cl.
*A63B 21/072* (2006.01)
*A63B 21/00* (2006.01)
*A63B 23/035* (2006.01)

(52) U.S. Cl.
CPC ..... *A63B 21/0728* (2013.01); *A63B 21/0724* (2013.01); *A63B 21/4035* (2015.10); *A63B 23/03575* (2013.01)

(58) Field of Classification Search
CPC ..... A63B 21/0724; A63B 21/0728; A63B 21/4035; A63B 23/03575
See application file for complete search history.

(56) References Cited

U.S. PATENT DOCUMENTS

| | | | | |
|---|---|---|---|---|
| 9,636,538 | B2 * | 5/2017 | DiPasquale | A63B 21/0728 |
| 10,583,317 | B2 * | 3/2020 | Amyan | A63B 21/0724 |
| 2013/0065738 | A1 * | 3/2013 | Henniger | A63B 21/0728 482/104 |
| 2018/0126211 | A1 * | 5/2018 | Chen | A63B 21/4033 |
| 2018/0296873 | A1 * | 10/2018 | Amyan | A63B 21/4035 |

* cited by examiner

*Primary Examiner* — Joshua Lee
(74) *Attorney, Agent, or Firm* — NK Patent Law

(57) ABSTRACT

Weightlifting system includes a frame and a pair of opposed bars. Each bar is coupled to a respective end of the frame. Weight supporting protrusions extend upwardly from a respective end of each bar. At least one weight plate is mounted on each of the weight supporting protrusions. A support member extends upwardly from a medial point of the frame. A handle is coupled to the support member. The handle is configured for lifting the weightlifting system by a person.

20 Claims, 6 Drawing Sheets

WEIGHTLIFTING EXERCISE DEVICE

CROSS-REFERENCE TO RELATED APPLICATIONS

This application claims priority to U.S. Provisional Patent Application 63/014,769 filed on Apr. 24, 2020, the contents of which is hereby incorporated by reference in its entirety.

TECHNICAL FIELD

The present invention relates generally to weightlifting apparatuses, and particularly to deadlift weightlifting systems and methods for building body strength.

BACKGROUND

Many people intend to improve their overall physical fitness and exercise devices can help with that. Weightlifting continues to increase in popularity, with weightlifting attracting participants of varying ages, abilities and goals. Weightlifters seek both the general health benefits and the sports-specific performance gains that can be achieved through a disciplined weight training program. Some weightlifters belong to health clubs that typically have a wide array of weightlifting equipment while others prefer to exercise in their homes, e.g., because of convenience, cost, and/or schedule. Although high quality and effective weightlifting equipment is available for home use, such equipment is usually too large, too cumbersome, and/or too expensive for most weightlift enthusiasts.

Weights used in performing weightlifting exercises can be dangerous if not maintained under control. Often, when a weightlifting exercise is performed with free weights such as barbells or dumbbells, a second individual, commonly known as a "spotter" must attend the lifter in order to assist the lifter should he lose control of the weights in order to avoid injury to the lifter or others nearby. This means that the lifter cannot safely exercise without someone present to serve as a spotter. However, it may be difficult to arrange to have a spotter to be available every time a lifter performs weightlifting exercises at home.

An important mode of weightlifting exercise is the dead lift where a barbell is brought from the floor up to the waist. For the purposes of this description, a "deadlift type exercise" is any exercise that involves lifting the dead weight of a barbell up from floor level while the lifter moves to a standing or squaring position. The most difficult stage of this exercise is when the lifter starts the lifting of the weight/load upward from floor level. This most difficult stage can limit the weight a person can work with, which in turn limits the benefits of the exercise for those muscle groups that are used during other stages of the deadlift exercise. Further, if the deadlift is not done properly, it can cause both short-term and long-term damage to the hip and the lower portion of the spinal cord of the lifter. Particularly, for weightlifters rehabilitating their backs after injury, an improper lift of the barbell can have long-term negative impact to the rehabilitating lifter's bones and muscles.

Accordingly, opportunities exist for providing a deadlift system that can minimize the risk of damage particularly to the hip and lower portion of the spinal cord during deadlift weightlifting exercises.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

Embodiments according to the invention can provide methods, systems and devices for weightlifting exercises.

Disclosed herein is a weightlifting system. In various embodiments, the weightlifting system comprises a frame and a pair of opposed bars. Each bar is coupled to a respective end of the frame. Weight supporting protrusions extend upwardly from a respective end of each bar. At least one weight plate is mounted on each of the weight supporting protrusions. A support member extends upwardly from a medial point of the frame. A handle is coupled to the support member, the handle being configured for lifting the weightlifting system by a person.

According to one or more embodiments, the weight supporting protrusions have a circular cross-section.

According to one or more embodiments, the handle comprises a left-side hand grip member and a right-side hand grip member.

According to one or more embodiments, the left-side hand grip member and the right-side hand grip member extend substantially parallel to the frame.

According to one or more embodiments, each of the left-side hand grip member and the right-side hand grip member has a substantially circular cross-section.

According to one or more embodiments, the left-side hand grip member and the right-side hand grip member are connected to each other by at least one crossbar.

According to one or more embodiments, the left-side hand grip member and the right-side hand grip member are engaged with the at least one crossbar by a bolting mechanism.

According to one or more embodiments, the opposed bars are spaced at least 4 feet from each other.

According to one or more embodiments, each weight plate includes an opening for a free end of the weight supporting protrusion to pass therethrough.

According to one or more embodiments, the support member extends substantially perpendicular to the frame.

According to one or more embodiments, the weight plates are configured for stacking one on top of the other.

According to one or more embodiments, the weight supporting protrusion is threadably engaged with the respective end of each bar.

According to one or more embodiments, the support member is threadably engaged with the frame.

According to one or more embodiments, that handle is configured for lifting the weightlifting system upward against gravity.

According to one or more embodiments, a height of handle relative to the frame is adjustable.

According to one or more embodiments, the support member comprises a telescopic assembly engaged about a first end with the frame and about a second end with the handle, the telescopic assembly separately positionable to vary a length thereof to adjust a height of the handle relative to the frame.

According to one or more embodiments, the telescopic assembly comprises a shaft having a plurality of height adjustment holes formed thereon, and a circumferential support member with a through hole, the circumferential support member configured for sliding over the shaft.

According to one or more embodiments, a locking member slides through one of the plurality of height adjustment holes and the through hole for securing the handle at a predetermined height.

According to one or more embodiments, the locking member comprises one or more of: a bolt and nut, and a spring-loaded peg.

Disclosed herein is a method of fabricating a weightlifting system. According to at least one embodiment, the method comprises providing a frame and coupling a pair of opposed bars to a respective end of the frame. The method further comprises attaching weight supporting protrusions to a respective end of each bar such that the weight supporting protrusions extend upwardly from the respective end of each bar, each of the weight supporting protrusions configured for mounting one or more weight plates. The method furthermore comprises attaching a support member to the frame such that the support member extends upwardly from a medial point of the frame. The method also comprises coupling a handle to the support member, the handle configured for lifting the weightlifting system by a person.

BRIEF DESCRIPTION OF THE DRAWINGS

The foregoing, as well as the following Detailed Description of preferred embodiments, is better understood when read in conjunction with the appended drawings. For the purposes of illustration, there is shown in the drawings exemplary embodiments; however, the presently disclosed subject matter is not limited to the specific methods and instrumentalities disclosed.

The embodiments illustrated, described, and discussed herein are illustrative of the present invention. As these embodiments of the present invention are described with reference to illustrations, various modifications or adaptations of the methods and or specific structures described may become apparent to those skilled in the art. It will be appreciated that modifications and variations are covered by the above teachings and within the scope of the appended claims without departing from the spirit and intended scope thereof. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

In the drawings like characters of reference indicate corresponding parts in the different figures.

DETAILED DESCRIPTION OF THE EMBODIMENTS

Figure 1:
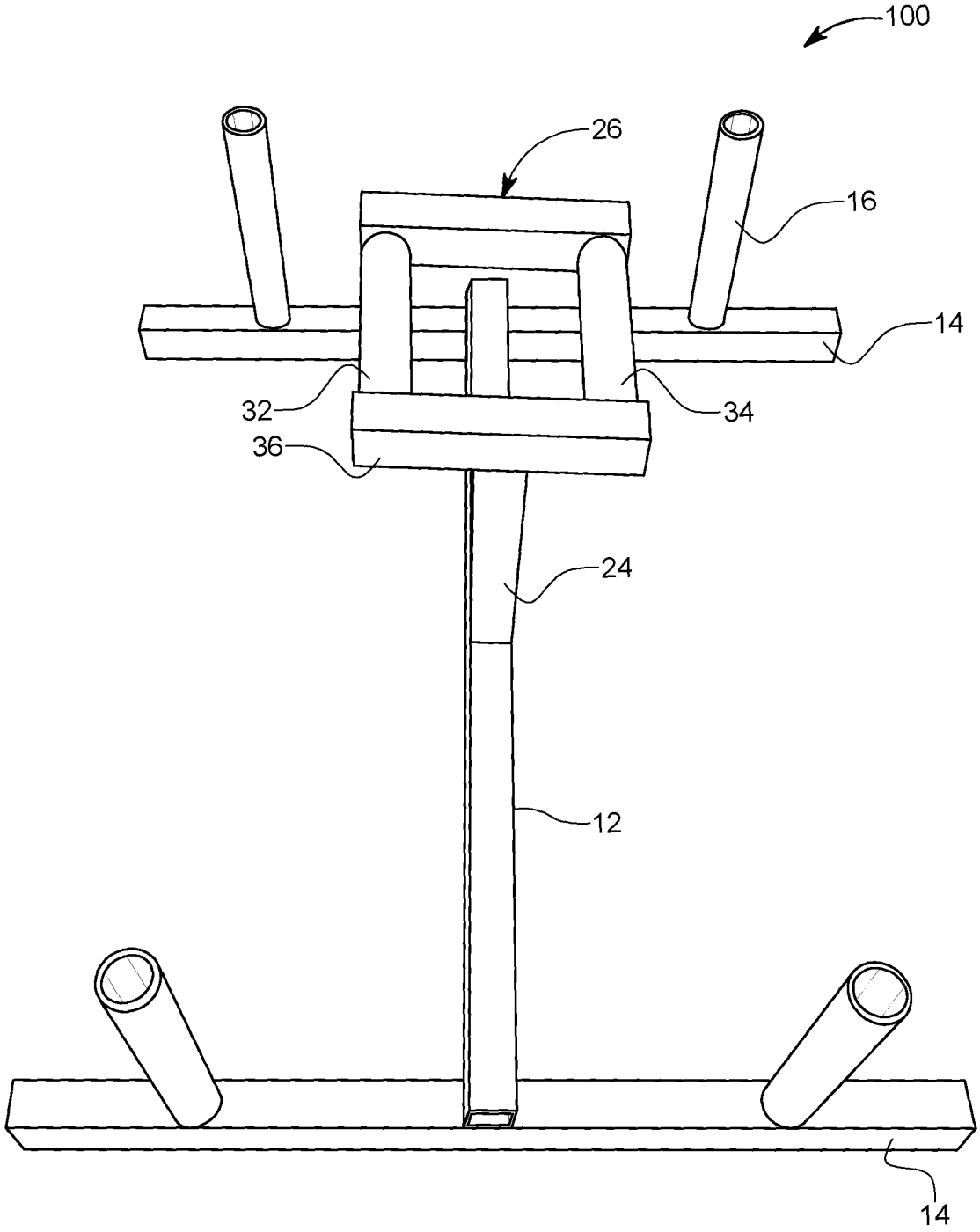
FIG. 1 illustrates a top perspective view of a weightlifting system, according to one or more embodiments of the presently disclosed subject matter.
Figure 2:
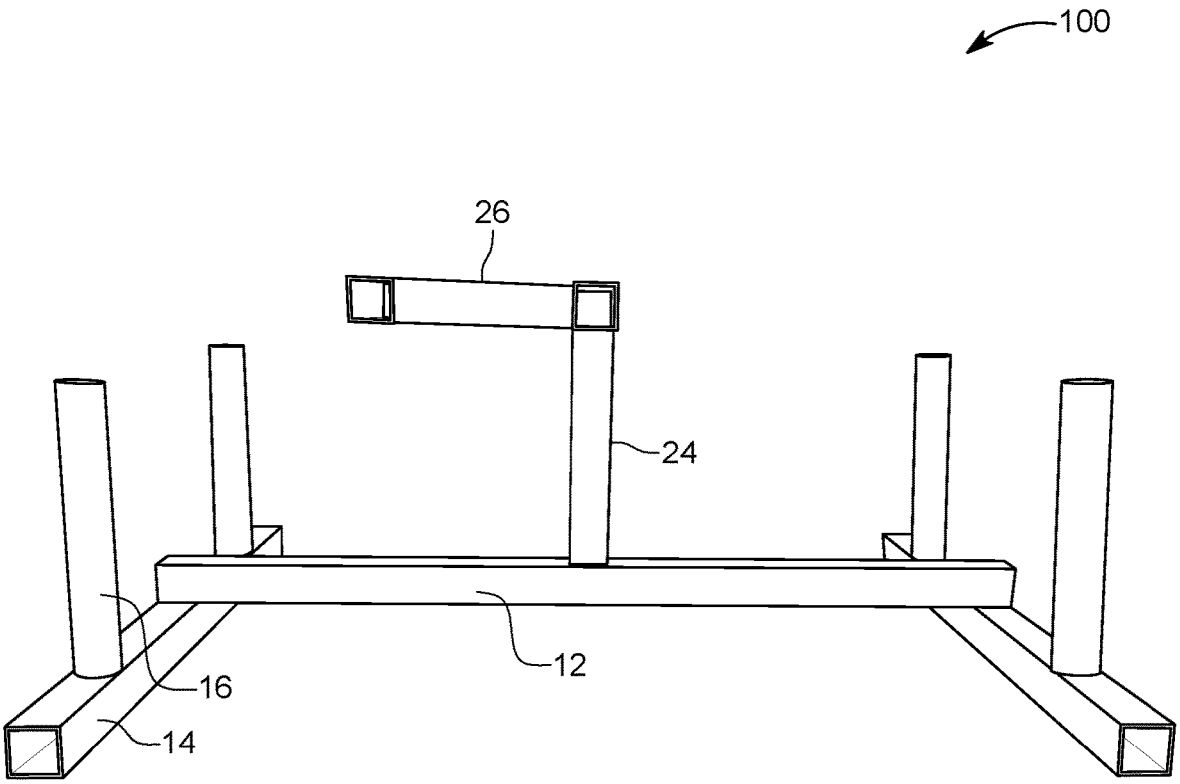
FIG. 2 illustrates a side elevation perspective view of a weightlifting system, according to one or more embodiments of the presently disclosed subject matter.
Figure 3:
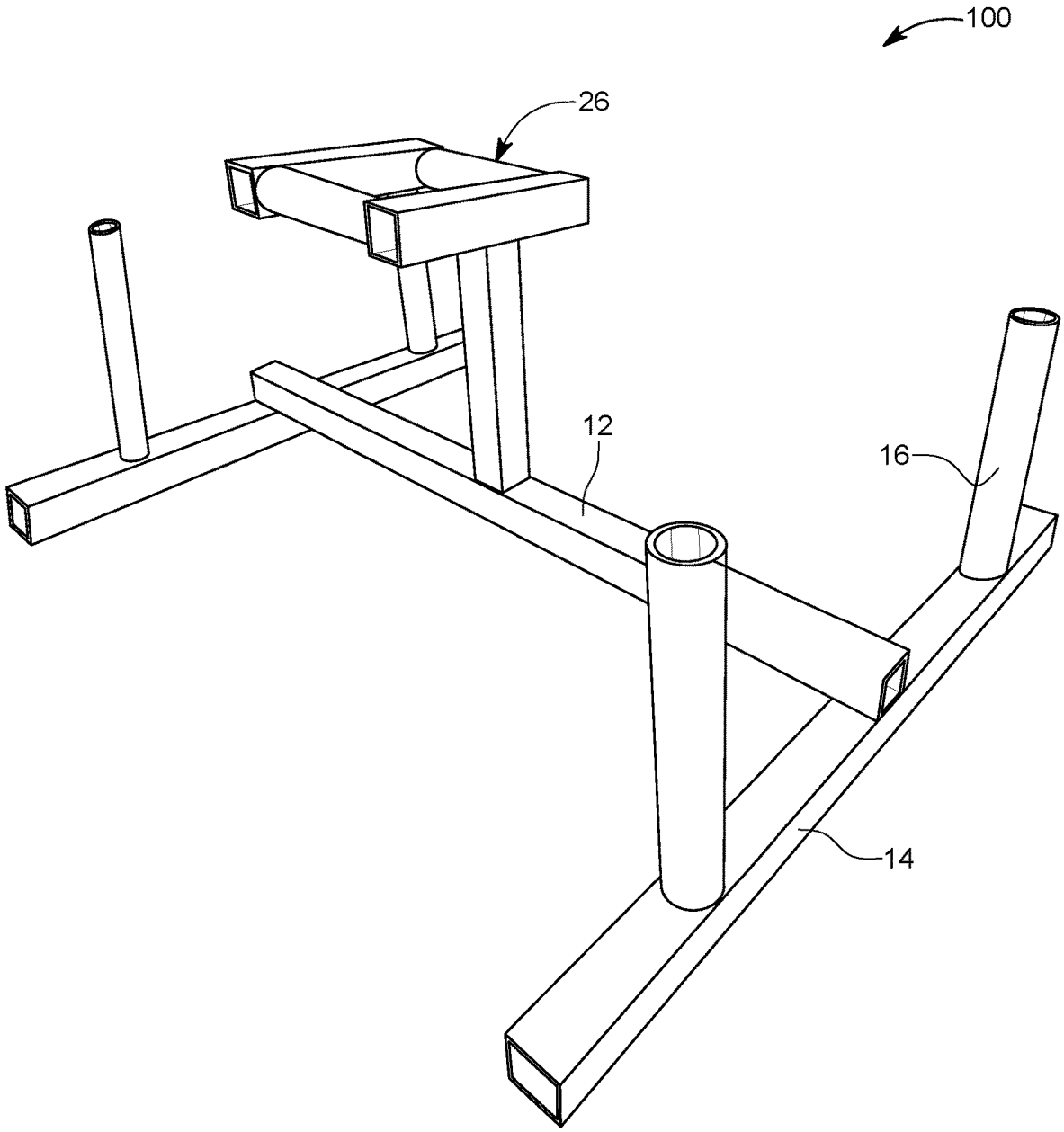
FIG. 3 illustrates an end perspective view of a weightlifting system, according to one or more embodiments of the presently disclosed subject matter.

The following description and figures are illustrative and are not to be construed as limiting. Numerous specific details are described to provide a thorough understanding of the disclosure. In certain instances, however, well-known or conventional details are not described in order to avoid obscuring the description. Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. It will be appreciated that same thing can be said in more than one way.

Alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and is not intended to further limit the scope and meaning of the disclosure or of any exemplified term. Likewise, the disclosure is not limited to various embodiments given in this specification.

Without intent to limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure.

As will be described in greater detail below with reference to the figures, the subject matter described herein provides for methods, devices and systems for improved ways to deadlift weights. Embodiments of the presently disclosed subject matter provide for a weightlifting system that can advantageously minimize the risk of damage to hip and lower portion of the spinal cord during deadlift weightlifting exercises.

With conventional deadlift where the bar is in front of the lifter, during the lifting phase, the hips are kicked back with the load primarily being forced upon the lower back and hamstrings of the lifter with minimal load being picked up by the hip, even though the hip is the strongest point of the body as it relates to load bearing. By contrast, embodiments of the presently disclosed subject matter can advantageously allow a lifter to maintain his/her hip in closer vertical alignment with the lower torso during the lifting phase—with the feet positioned more or less in vertical alignment directly below the hip—maximum engagement of the hip. In other words, during the lifting maneuver of the weightlifting system as disclosed herein, the head, the lower torso, the hip and the feet of the lifter can all stay better aligned close to a vertical axis passing through the feet and head of the lifter as illustrated, for example, FIGS. 4 through 6. The weightlifting system as described herein can further advantageously allow a lifter's back to be less slanted as compared to conventional deadweight lifting equipment and technics. The weightlifting system as described herein can furthermore allow the lifter's hips to be positioned substantially underneath the lifter's lower back. Embodiments of the presently disclosed subject matter can accordingly allow a lifter with back injury to slowly and consistently build back strength over time while minimizing strain on the lifter's posterior chain; the lifter with back injury can accomplish this, for example, by gradually increasing the weights in the weightlifting system as disclosed herein. Embodiments of the presently disclosed subject matter can be particularly beneficial to a lifter who is rehabilitating his/her back after an injury.

Embodiments of the presently disclosed subject matter can advantageously allow for the ability to adjust the height of the handle of the weightlifting system relative to the frame/base. By raising the handle, the lifter can advantageously focus more on "lock out" aspect of the deadlift repetitions to maximize engagement of the trapezius and other muscles on the upper back. On the other hand, by lowering the handle, the lifter can advantageously get deeper "in the hole" thereby focusing more on a longer and harder lift that engages most muscles from the top of the lifter's back all the way to the calf muscle of the lifter's leg. Exercising with a lowered handle can consequently help in providing the lifter with the ability to create increased power and stamina when lifting with the handle at a predetermined regular height.

Figure 4:
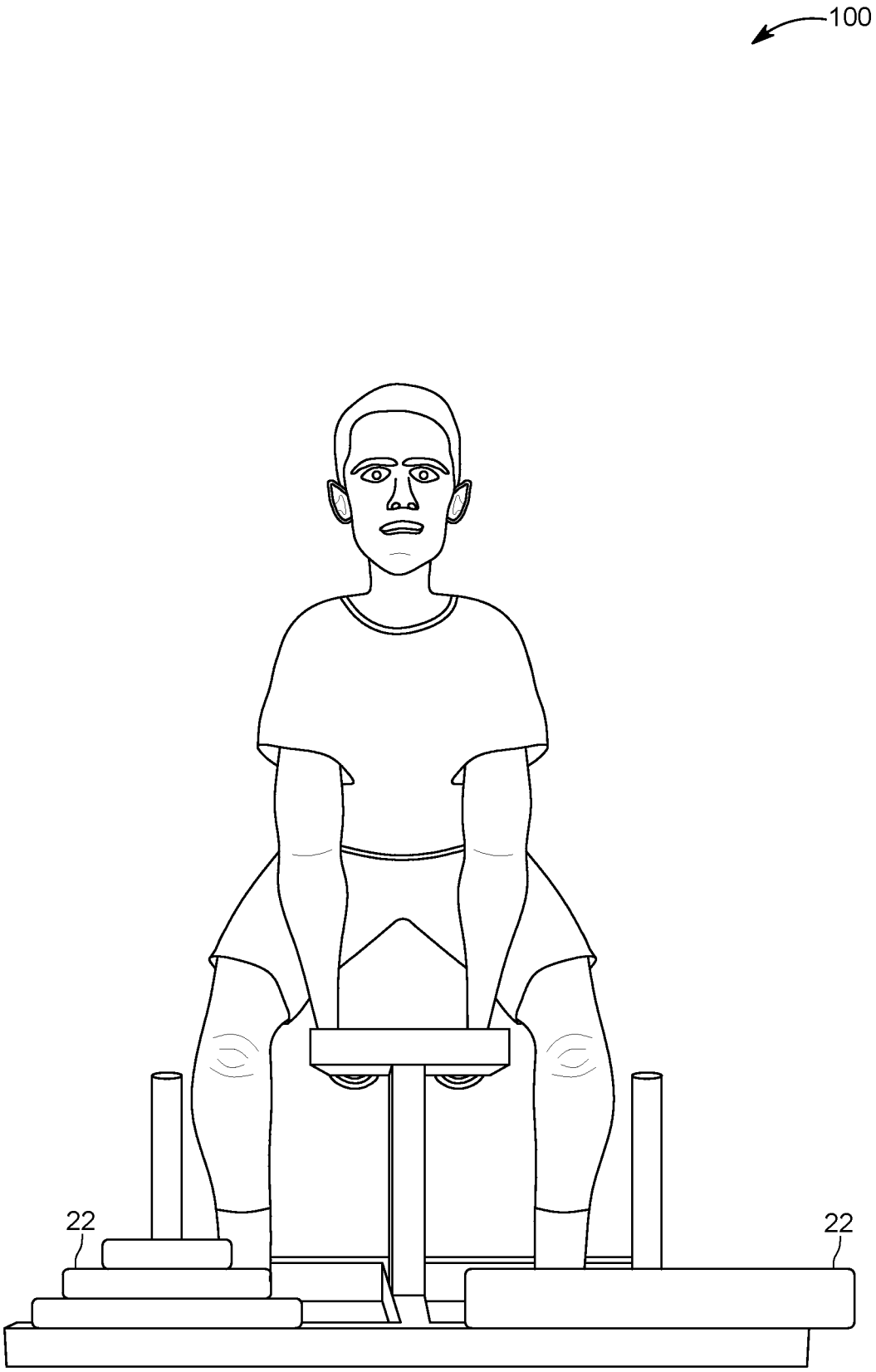
FIG. 4 illustrates a front elevation perspective view of a weightlifting system about to be lifted by a person, according to one or more embodiments of the presently disclosed subject matter.
Figure 5:
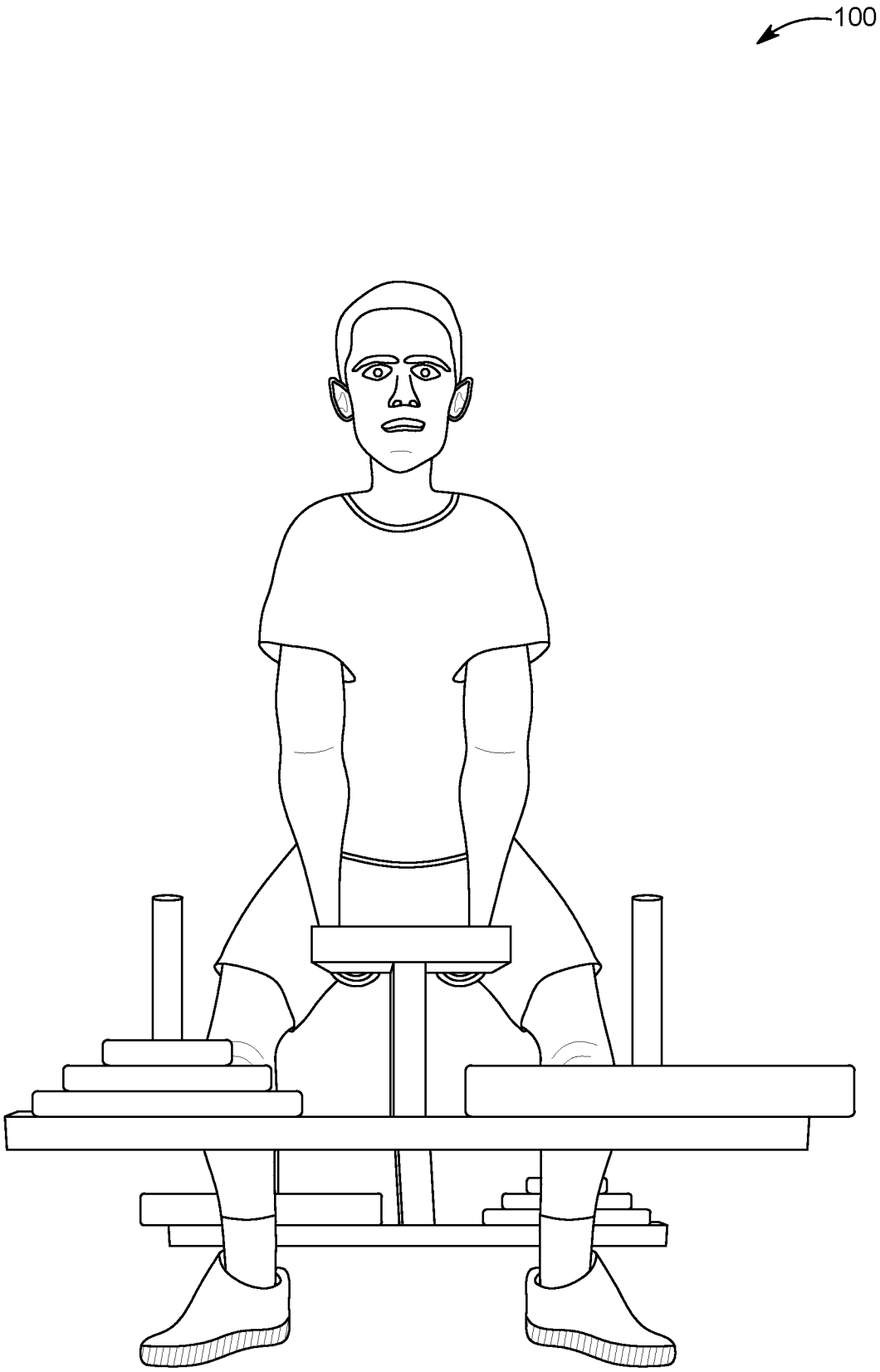
FIG. 5 illustrates a front elevation perspective view of a weightlifting system lifted halfway by a person, according to one or more embodiments of the presently disclosed subject matter.
Figure 6:
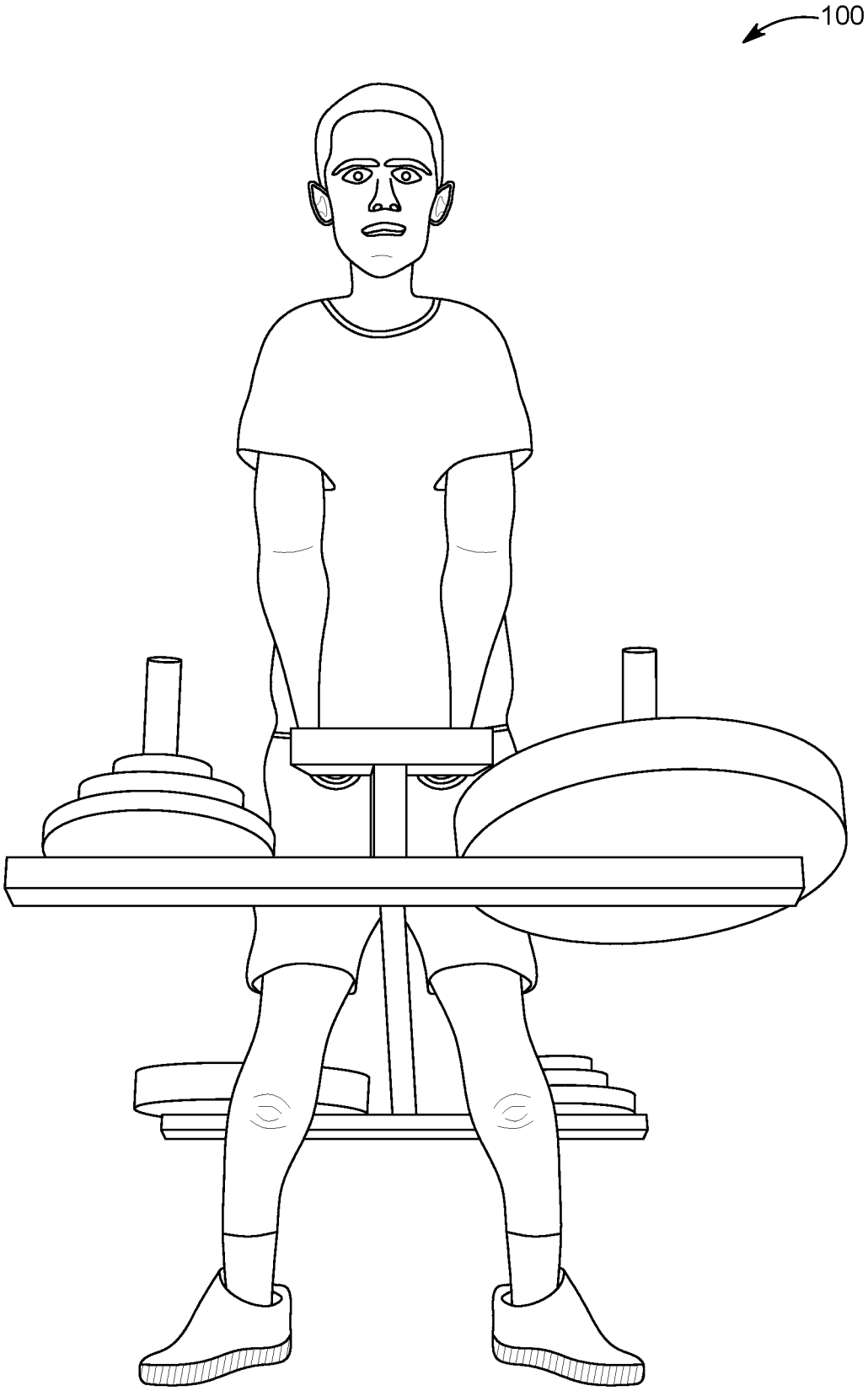
FIG. 6 illustrates a front elevation perspective view of a weightlifting system about to be lifted full way by a person, according to one or more embodiments of the presently disclosed subject matter.

FIGS. 1 through 6 illustrate a weightlifting system 100 according to one or more embodiments of the presently disclosed subject matter. According to at least one embodiment, weightlifting system 100 includes a frame 12 and a pair of opposed bars 14. Each bar 14 is coupled to a respective end of the frame 12. weight supporting protrusions 16 extend upwardly from a respective end of each bar 14. One or more weight plates 22 (shown for example in FIG. 4) can be mounted on each of the weight supporting protrusions 16. A support member 24 extends upwardly from a medial point of frame 12. A handle 26 is coupled to the top end of support member 24. Handle 26 is configured for lifting the weightlifting system 100 by a person. FIGS. 4 through 6 illustrate a person engaging handle 26 during the weightlifting process using weightlifting system 100.

In various embodiments, support member 24 may extend substantially perpendicular to the frame. In some embodiments, support member 24 is threadably engaged with the frame. In some embodiments, support member 24 is bolted to the frame. In some embodiments, the support member is welded to the frame.

According to at least one embodiment, a height of handle 26 relative to frame 12 is adjustable. In one embodiment, support member 24 can comprise a telescopic assembly engaged about a first end with frame 12 and about a second end with handle 26. The telescopic assembly can be separately positionable to vary a length thereof to adjust a height of handle 26 relative to frame 12. In at least one embodiment, the telescopic assembly can comprise a shaft having a plurality of height adjustment holes formed thereon, and a circumferential support member with a through hole, the circumferential support member configured for sliding over the shaft. A locking member can slide through one of the height adjustment holes and the through hole for securing the handle at a predetermined height. In various embodiments, the locking member can be in the form of a pin, a bolt and nut and/or a spring-loaded peg. Accordingly, the height of handle 26 can be adjusted by selecting an appropriate adjustment hole following which the pin, the bolt and nut and/or the spring-loaded peg operates to secure the handle 26 at a desired height above frame 12.

In various embodiments, weight supporting protrusions 16 can have a circular cross-section. However, other cross-sectional profiles such as triangle, square, rectangle and oval cross-sections are also possible. In one embodiment, the weight supporting protrusion is threadably engaged with the respective end of each bar. In one embodiment, the weight supporting protrusion is bolted to the respective end of each bar. In one embodiment, the weight supporting protrusion is welded to the respective end of each bar.

In at least one embodiment, opposed bars 14 are spaced at least 4 feet from each other. This can advantageously allow for a person to be positioned between the two bars 14 with the person's feet placed on either side of frame 12 during the lifting maneuver. However, the spacing between the bars 14 can be anywhere between 3 feet and 8 feet or higher, depending on the needs of the lifter or of the application at hand.

In various embodiments, handle 26 is configured for lifting the weightlifting system upward against gravity. In various embodiments, handle 26 comprises a left-side hand grip member 34 and a right-side hand grip member 32. As illustrated in FIG. 1, for example, left-side hand grip member 34 member and right-side hand grip member 32 can extend substantially parallel to frame 12 in one embodiment. In at least one embodiment, each of the left-side hand grip member and the right-side hand grip member can have a substantially circular cross-section; however, other cross-sections such as triangle, square, rectangle and oval cross-sections are also possible.

As illustrated in FIG. 1, in at least one embodiment, left-side hand grip member 34 and right-side hand grip member 32 can be connected to each other by one or more crossbars 36. In one embodiment, the left-side hand grip member and the right-side hand grip member are engaged with the at least one crossbar by a bolting mechanism. In one embodiment, the left-side hand grip member and the right-side hand grip member are welded with the at least one crossbar. In various embodiments, left-side hand grip member 34 and right-side hand grip member 32 can be of various types well known to persons skilled in this art including simply a capital D-shaped single hand grasping element, various forms of cross bar or T-bar, and the like.

In at least one embodiment, each weight plate 22 includes an opening for a free end of the weight supporting protrusion 16 to pass therethrough. Weight plates 22 can accordingly stacked one on top of the other by passing the opening in weight plate 22 through the free end of the weight supporting protrusion 16 as illustrated, for example, in FIGS. 4-6. Accordingly, in various embodiments, the weight plates can be configured for stacking one on top of the other.

According to one or more embodiments, a method of fabricating a weightlifting system such as weightlifting system 100 can include the following steps. The method of fabricating weightlifting system 100 comprises coupling a pair of opposed bars 14 to a respective end of a frame 12. The method further includes attaching weight supporting protrusions 16 to a respective end of each bar 14 such that the weight supporting protrusions extend upwardly from the respective end of each bar 14 with each of the weight supporting protrusions being configured for mounting one or more weight plates. The method also includes attaching a support member 24 to the frame 12 such that support member 24 extends upwardly from a medial point of the frame 12. The method additionally includes coupling a handle 26 to support member 24 with the 26 being configured for lifting of weightlifting system 100 by a person. Weight plates 22 can then be added for undertaking weightlifting exercises.

In one embodiment, frame 12 can be fabricated from angle iron, the L-shaped cross-section of the angle iron providing for great strength and durability. Moreover, in at least one embodiment, the various components of weightlifting system 100 can be secured together through welding or with a plurality of bolts and cooperating nuts, such that weightlifting system 100 can be easily disassembled and reassembled to facilitate transport and storage.

Embodiments of the presently disclosed subject matter obviate the need for a spotter in other prior art weightlifting equipment for catching the weights should the lifter lose control of the weights or become tired. Should the lifter lose control of the weightlifting system 100 while exercising, it can be lowered easily without causing any injuries to the any part of the lifter's body. Embodiments of the presently disclosed subject matter can be advantageously used by people who have conditions such as arthritis, carpal tunnel syndrome, hand fatigue, tendonitis, poor circulation, stress related injuries and/or repetitive strain injury.

In light of the above, it will be appreciated that embodiments of the presently disclosed subject matter advantageously provides an improved weightlifting equipment which allows weightlifting exercises to be safely performed without a spotter. Moreover, embodiments of the presently disclosed subject matter advantageously prevent injuries to the any part of the lifter's body should the lifter lose control of the weightlifting system.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be understood that when an element or layer is referred to as being "on" another element or layer, the element or layer can be directly on another element or layer or intervening elements or layers may also be present. In contrast, when an element is referred to as being "directly on" another element or layer, there are no intervening elements or layers present. As used herein, the term "and/or" includes any and all combinations of one or more of the associated listed items.

Spatially relative terms, such as "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. Throughout the specification, like reference numerals in the drawings denote like elements.

Embodiments of the inventive subject matter are described herein with reference to plan and perspective illustrations that are schematic illustrations of idealized embodiments of the inventive subject matter. As such, variations from the shapes of the illustrations as a result, for example, of manufacturing techniques and/or tolerances, are to be expected. Thus, the inventive subject matter should not be construed as limited to the particular shapes of objects illustrated herein, but should include deviations in shapes that result, for example, from manufacturing. Thus, the objects illustrated in the figures are schematic in nature and their shapes are not intended to illustrate the actual shape of a region of a device and are not intended to limit the scope of the inventive subject matter.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item. Although any methods, devices, and materials similar or equivalent to those described herein can be used in the practice or testing of the presently disclosed subject matter, representative methods, devices, and materials are now described.

In the drawings and specification, there have been disclosed typical preferred embodiments of the inventive subject matter and, although specific terms are employed, they are used in a generic and descriptive sense only and not for purposes of limitation, the scope of the inventive subject matter being set forth in the following claims.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

These and other changes can be made to the disclosure in light of the Detailed Description. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms. Accordingly, the actual scope of the disclosure encompasses not only the disclosed embodiments, but also all equivalent ways of practicing or implementing the disclosure under the claims.

What is claimed is:

1. A weightlifting system comprising:

a frame;

a pair of opposed bars, each bar coupled to a respective end of the frame;

weight supporting protrusions extending upwardly from a respective end of each bar;

at least one weight plate mounted on each of the weight supporting protrusions;

a support member extending upwardly from a medial point of the frame;

a handle coupled to the support member, the handle configured for lifting the weightlifting system by a person.

2. The system of claim 1, wherein the weight supporting protrusions have a circular cross-section.

3. The system of claim 1, wherein the handle comprises a left-side hand grip member and a right-side hand grip member.

4. The system of claim 3, wherein the left-side hand grip member and the right-side hand grip member extend substantially parallel to the frame.

5. The system of claim 3, wherein each of the left-side hand grip member and the right-side hand grip member has a substantially circular cross-section.

6. The system of claim 3, wherein the left-side hand grip member and the right-side hand grip member are connected to each other by at least one crossbar.

7. The system of claim 6, wherein the left-side hand grip member and the right-side hand grip member are engaged with the at least one crossbar by a bolting mechanism.

8. The system of claim 1, wherein the opposed bars are spaced at least 4 feet from each other.

9. The system of claim 1, wherein each weight plate includes an opening for a free end of the weight supporting protrusion to pass therethrough.

10. The system of claim 1, wherein the support member extends substantially perpendicular to the frame.

11. The system of claim 1, wherein the weight plates are configured for stacking one on top of the other.

12. The system of claim 1, wherein the weight supporting protrusion is threadably engaged with the respective end of each bar.

13. The system of claim 1, wherein the support member is threadably engaged with the frame.

14. The system of claim 1, wherein the handle is configured for lifting the weightlifting system upward against gravity.

15. The system of claim 1, wherein a height of the handle relative to the frame is adjustable.

16. The system of claim 15, wherein the support member comprises a telescopic assembly engaged about a first end with the frame and about a second end with the handle, the telescopic assembly separately positionable to vary a length thereof to adjust a height of the handle relative to the frame.

17. The system of claim 16, wherein the telescopic assembly comprises a shaft having a plurality of height adjustment holes formed thereon, and a circumferential support member with a through hole, the circumferential support member configured for sliding over the shaft.

18. The system of claim 17, wherein a locking member slides through one of the plurality of height adjustment holes and the through hole for securing the handle at a predetermined height.

19. The system of claim 18, wherein the locking member comprises one or more of: a bolt and nut, and a spring-loaded peg.

20. A method of fabricating a weightlifting system, comprising:

providing a frame;

coupling a pair of opposed bars to a respective end of the frame;

attaching weight supporting protrusions to a respective end of each bar such that the weight supporting protrusions extend upwardly from the respective end of each bar, each of the weight supporting protrusions configured for mounting one or more weight plates;

attaching a support member to the frame such that the support member extends upwardly from a medial point of the frame;

coupling a handle to the support member, the handle configured for lifting the weightlifting system by a person.

* * * * *